US008485338B2

(12) United States Patent
Oba et al.

(10) Patent No.: US 8,485,338 B2
(45) Date of Patent: Jul. 16, 2013

(54) PAPER MONEY PROCESSOR

(75) Inventors: Masashi Oba, Oyama (JP); Wataru Iida, Matsudo (JP); Taki Ohishi, Tokyo (JP); Keisuke Sato, Saitama (JP); Masahiro Hagiwara, Kasukabe (JP); Hiroki Nagahama, Koshigaya (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 531 days.

(21) Appl. No.: 12/706,148

(22) Filed: Feb. 16, 2010

(65) Prior Publication Data

US 2010/0206689 A1 Aug. 19, 2010

(30) Foreign Application Priority Data

Feb. 17, 2009 (JP) ..... P2009-034192

(51) Int. Cl.
*G07F 1/00* (2006.01)

(52) U.S. Cl.
USPC ..... 194/351; 194/206; 194/350; 902/17

(58) Field of Classification Search
USPC ..... 194/206, 207, 214, 344, 350, 351; 902/8, 902/17; 209/534; D18/3.1, 12.1, 48, 49; 271/3.14; 235/454; 399/405
See application file for complete search history.

(56) References Cited

U.S. PATENT DOCUMENTS

| | | | | |
|---|---|---|---|---|
| 4,733,765 | A | 3/1988 | Watanabe | |
| 5,897,114 | A | 4/1999 | Arikawa et al. | |
| 2004/0108328 | A1 | 6/2004 | Youn | |
| 2005/0127590 | A1 | 6/2005 | Ugo et al. | |
| 2006/0210342 | A1* | 9/2006 | Fujikawa et al. | 400/586 |
| 2007/0000752 | A1 | 1/2007 | Yoshioka | |
| 2007/0000821 | A1* | 1/2007 | Nagura | 209/534 |
| 2007/0001390 | A1 | 1/2007 | Yoshioka | |
| 2007/0125622 | A1 | 6/2007 | Yoshioka | |
| 2008/0142583 | A1 | 6/2008 | Yokoi et al. | |
| 2008/0272540 | A1 | 11/2008 | Ugo et al. | |
| 2009/0120759 | A1 | 5/2009 | Nagura | |
| 2010/0170911 | A1* | 7/2010 | Gunst et al. | 221/1 |

FOREIGN PATENT DOCUMENTS

| | | |
|---|---|---|
| EP | 0 793 197 A2 | 9/1997 |
| EP | 1 424 660 A2 | 6/2004 |
| EP | 1 926 057 A1 | 5/2008 |
| EP | 1 734 487 | 7/2008 |
| JP | 55-119775 | 9/1980 |
| JP | 58-179560 | 12/1983 |

(Continued)

OTHER PUBLICATIONS

Notice of Allowance and English translation in KR 10-2010-0013404 mailed Oct. 31, 2011.

(Continued)

*Primary Examiner* — Jeffrey Shapiro
(74) *Attorney, Agent, or Firm* — Nixon & Vanderhye P.C.

(57) ABSTRACT

A paper money processor according to the present invention includes a transaction slot where paper money is at least either inserted or dispensed with an orientation such that one of lengthwise ends of the paper money is positioned at a side of a first lengthwise end of the transaction slot. The transaction slot includes a main opening which opens on a second lengthwise end of the transaction slot, and a lateral opening which is continuous with the main opening, and opens on a first widthwise end of the transaction slot.

14 Claims, 9 Drawing Sheets

FOREIGN PATENT DOCUMENTS

| | | | |
|---|---|---|---|
| JP | 06-274742 | | 9/1994 |
| JP | 07-121750 | | 5/1995 |
| JP | 9-237371 | | 9/1997 |
| JP | 09-259326 | | 10/1997 |
| JP | 2004-118602 | | 4/2004 |
| KR | 10-2007-0071799 | A | 7/2007 |
| TW | 497741 | | 8/2002 |
| TW | M252088 | | 12/2004 |
| TW | 200713130 | | 4/2007 |
| TW | 200839655 | | 10/2008 |
| TW | I303576 | | 12/2008 |
| WO | WO 01/63566 | A1 | 8/2001 |

OTHER PUBLICATIONS

Partial English translation of WO 01/63566.
Extended European Search Report in EP 10 15 3284 dated Apr. 9, 2010.
Office Action issued in Japanese Application No. 2009-034192 dated Feb. 5, 2013 (with translation).
Office Action issued in Taiwanese Application No. 099103988 dated Apr. 10, 2013 (with translation of Search Report).
Notice of Allowance issued in Japanese Application No. 2009-034192 dated Apr. 23, 2013 (with translation).

* cited by examiner

PAPER MONEY PROCESSOR

BACKGROUND OF THE INVENTION

1. Field of the Invention

The present invention relates to a paper money processor.

Priority is claimed on Japanese Patent Application No. 2009-034192, filed Feb. 17, 2009, the content of which is incorporated herein by reference.

2. Description of Related Art

With respect to, for example, the paper money of some countries other than Japan, there are cases of comparatively large dimensional differences in the lengthwise direction according to the denomination of the bills. In order to efficiently process paper money having such large dimensional differences, there is a paper money processor which conducts conveyance with an orientation that aligns the lengthwise direction of the paper money with the conveyance direction (e.g., see Japanese Unexamined Patent Application, First Publication No. H09-237371).

Paper money processors which convey paper money by aligning its lengthwise direction with the conveyance direction as mentioned above, has a transaction slot where the paper money is inserted from outside the device or dispensed from within the device. The transaction slot receives the paper money with an orientation such that one of its lengthwise ends is positioned on the inner side of the device body in alignment with the conveyance orientation. With this type of transaction slot, in the case where inserted paper money is removed upon cancellation of processing or where paper money is removed when dispensed from within the device, there is the problem that it is difficult to conduct removal when dimensional differences of the bills are large.

SUMMARY OF THE INVENTION

An object of the present invention is to provide a paper money processor which enables easy removal even when dimensional differences of the bills are large.

A paper money processor according to a first aspect of the present invention includes a transaction slot where paper money is at least either inserted or dispensed with an orientation such that one of lengthwise ends of the paper money is positioned at a side of a first lengthwise end of the transaction slot. The transaction slot includes: a main opening which opens on a second lengthwise end of the transaction slot; and a lateral opening which is continuous with the main opening, and opens on a first widthwise end of the transaction slot.

According to this structure, a transaction slot—where paper money is at least either inserted or dispensed with an orientation such that one of lengthwise ends of the paper money is positioned at a side of a first lengthwise end of the transaction slot—includes: a main opening which opens on a second lengthwise end of the transaction slot; and a lateral opening which is continuous with the main opening, and opens on a first widthwise end of the transaction slot. Consequently, even when a paper money pile with large dimensional differences is in a transaction slot, all of the bills of the paper money can be simultaneously gripped from the second lengthwise end of the transaction slot, and removed in this state to the side of the second lengthwise end of the transaction slot, enabling easy removal.

With respect to the paper money processor of the first aspect of the present invention, the transaction slot may further include: an inner narrowing portion which positions at the first lengthwise end side of the transaction slot; and an enlargement portion which positions at the second lengthwise end side of the transaction slot and has an oblique shape so that a dimension in a height direction of the transaction slot widens toward at the second lengthwise end of the transaction slot, and a dimension of the inner narrowing portion in the height direction of the transaction slot is narrower than a dimension of at least a portion of the enlargement portion in the height direction of the transaction slot.

According to this structure, the transaction slot stabilizes the orientation of a paper money pile with the inner narrowing portion whose dimension in the height direction of the transaction slot is narrower than a dimension of at least a portion of the enlargement portion in the height direction of the transaction slot, and facilitates gripping of the paper money pile at the side of the enlargement portion which positions at the second lengthwise end side of the transaction slot and has an oblique shape so that a dimension in a height direction of the transaction slot widens toward at the second lengthwise end of the transaction slot. Accordingly, removal is further facilitated.

With respect to the paper money processor of the first aspect of the present invention, the transaction slot may further include: an inner narrowing portion which positions at the first lengthwise end side of the transaction slot; and an enlargement portion which positions at the first widthwise end side of the transaction slot at the second lengthwise end side of the transaction slot, and has an oblique shape so that a dimension in a height direction of the transaction slot widens toward the second lengthwise end side of the transaction slot; and an outer narrowing portion which positions at a second widthwise end side of the transaction slot at the second lengthwise end side of the transaction slot. A dimension of the inner narrowing portion in the height direction of the transaction slot may be narrower than a dimension of at least a portion of the enlargement portion in the height direction of the transaction slot, and a dimension of the outer narrowing portion in the height direction of the transaction slot may be equal to a dimension of the inner narrowing portion in the height direction of the transaction slot.

According to this structure, the transaction slot stabilizes the orientation of a paper money pile with the inner narrowing portion which positions at the first lengthwise end side of the transaction slot and the outer narrowing portion which positions at a second widthwise end side of the transaction slot at the second lengthwise end side of the transaction slot, dimensions of which are in the height direction of the transaction slot are equal to each other, and facilitate gripping of the paper money pile at the side of the enlargement portion which positions at the second lengthwise end side of the transaction slot and has an oblique shape so that a dimension in a height direction of the transaction slot widens toward at the second lengthwise end of the transaction slot. Accordingly, removal is further facilitated.

The paper money processor of the first aspect of the present invention may further include a shutter which has a curved shape, and is capable of covering the main opening and the lateral opening of the transaction slot.

According to this structure, as the main opening and the lateral opening are covered by the shutter having a curved shape, it is possible to open and close the main opening and the lateral opening by means of a simple structure.

With respect to the paper money processor of the first aspect of the present invention, the transaction slot may further include a light unit.

According to this structure, since the transaction slot has a light unit, a paper money pile can be reliably removed without forgetting to take bills which are particularly short in lengthwise length.

A paper money processor according to a second aspect of the present invention includes: an insertion slot where paper money is inserted with an orientation such that one of lengthwise ends of the paper money is positioned at a side of a first lengthwise end of the insertion slot, the insertion slot including: a main opening which opens on a second lengthwise end of the insertion slot; and a lateral opening which is continuous with the main opening, and opens on a first widthwise end of the insertion slot; and a dispensing slot where paper money is dispensed with an orientation such that one of lengthwise ends of the paper money is positioned at a side of a first lengthwise end of the dispensing slot, the dispensing slot including: a main opening which opens on a second lengthwise end of the dispensing slot; and a lateral opening which is continuous with the main opening, and opens on a first widthwise end of the dispensing slot.

According to this structure, both the insertion slot where paper money is inserted with an orientation such that one of lengthwise ends of the paper money is positioned at a side of a first lengthwise end of the insertion slot, the insertion slot and the dispensing slot where paper money is dispensed with an orientation such that one of lengthwise ends of the paper money is positioned at a side of a first lengthwise end of the dispensing slot, the dispensing slot include a main opening which opens on a second lengthwise end of the insertion slot or the dispensing slot and a lateral opening a lateral is continuous with the main opening, and opens on a first widthwise end of the insertion slot or the dispensing slot. Consequently, when a paper money pile with large dimensional differences is in either the insertion slot or the dispensing slot, all bills of the paper money can be simultaneously gripped from the side of the first widthwise end of the insertion slot or the dispensing slot, and removed in this state at the side of the second lengthwise end of the insertion slot or the dispensing, enabling easy removal.

With respect to the paper money processor of the second aspect of the present invention, the insertion slot may further include: an inner narrowing portion which positions at the first lengthwise end side of the insertion slot; and an enlargement portion which positions at the second lengthwise end side of the insertion slot and has an oblique shape so that a dimension in a height direction of the insertion slot widens toward the second lengthwise end side of the insertion slot, and a dimension of the inner narrowing portion in the height direction of the insertion slot is narrower than a dimension of at least a portion of the enlargement portion in the height direction of the insertion slot.

According to this structure, the insertion slot stabilizes the orientation of a paper money pile with the inner narrowing portion whose dimension in the height direction of the insertion slot is narrower than a dimension of at least a portion of the enlargement portion in the height direction of the insertion slot, and facilitates gripping of the paper money pile at the side of the enlargement portion which has an oblique shape so that a dimension in a height direction of the insertion slot widens toward the second lengthwise end side of the insertion slot. Accordingly, removal is further facilitated.

With respect to the paper money processor of the second aspect of the present invention, the dispensing slot may further include: an inner narrowing portion which positions at the first lengthwise end side of the dispensing slot; an enlargement portion which positions at the first widthwise end side of the dispensing slot at the second lengthwise end side of the dispensing slot and has an oblique shape so that a dimension in a height direction of the dispensing slot widens toward the second lengthwise end of the dispensing slot; and an outer narrowing portion which positions at a second widthwise end side of the dispensing slot at the second lengthwise end side of the dispensing slot, a dimension of the inner narrowing portion in the height direction of the dispensing slot is narrower than a dimension of at least a portion of the enlargement portion in the height direction of the dispensing slot, and a dimension of the outer narrowing portion in the height direction of the dispensing slot is equal to a dimension of the inner narrowing portion in the height direction of the dispensing slot.

According to this configuration, the dispensing slot stabilizes the orientation of a paper money pile with the inner narrowing portion which positions at the first lengthwise end side of the dispensing slot and the outer narrowing portion which positions at a second widthwise end side of the dispensing slot at the second lengthwise end side of the dispensing slot, dimensions of which are in the height direction of the dispensing slot are equal to each other, and facilitates gripping of the paper money pile at the side of the enlargement portion which positions at a second widthwise end side of the dispensing slot at the second lengthwise end side of the dispensing slot. Accordingly, removal is further facilitated.

The paper money processor of the second aspect of the present invention may further include a shutter which has a curved shape, is commonly used between the insertion slot and the dispensing slot, and is capable of covering the main openings and the lateral openings of the insertion slot and the dispensing slot. The insertion slot and the dispensing slot may be adjacently arranged with alignment in a height direction of the insertion slot so that the main openings of the insertion slot and the dispensing slot are respectively oriented to same side and the lateral openings of the insertion slot and the dispensing slot are respectively oriented to same side.

According to this structure, the paper money processor includes a shutter which has a curved shape, is commonly used between the insertion slot and the dispensing slot, and is capable of covering the main openings and the lateral openings of the insertion slot and the dispensing slot—which are adjacently arranged with alignment in a height direction of the insertion slot so that the main openings of the insertion slot and the dispensing slot are respectively oriented to same side and the lateral openings of the insertion slot and the dispensing slot are respectively oriented to same side. Consequently, it is possible to open and close the respective main openings and lateral openings of the insertion slot and dispensing slot by means of a simple structure.

With respect to the paper money processor of the second aspect of the present invention, the shutter may include two shutter bodies which are capable of overlapping with each other.

According to this structure, since the shutter includes two shutter bodies which is capable of displaced overlapped with each other Therefore, by moving one of the shutter bodies to the other shutter body side to overlap the other shutter body, the main opening and lateral opening of the dispensing slot can be opened while the main opening and lateral opening of the insertion slot are in a closed state. On the other hand, by moving the other shutter body to the one shutter body side to overlap the one shutter body, the main opening and lateral opening of the insertion slot can be opened while the main opening and lateral opening of the dispensing slot are in a closed state. Consequently, it is possible to selectively open one of the insertion slot and dispensing slot by means of a simple structure.

With respect to the paper money processor of the second aspect of the present invention, at least one of the insertion slot and the dispensing slot may further include a light unit.

According to this structure, since at least one of the insertion slot and the dispensing slot has a lighting unit, a paper money pile can be reliably removed without forgetting to take bills which are particularly short in lengthwise length.

DETAILED DESCRIPTION OF THE INVENTION

A paper money processor according to one embodiment of the present invention is described below with reference to drawings. In the following description, the side toward the operator is referred to as "front," the side away from the operator as "rear," left from the viewpoint of the operator as "left," and right from the viewpoint of the operator as "right."

A paper money processor 11 of the present embodiment conducts processing while conveying paper money S with an orientation that aligns its lengthwise direction with the conveyance direction. Specifically, the paper money processor 11 may be a paper money processor capable of conducting money intake and storage processing which counts and then takes in and stores the paper money S, and counting processing which counts and then returns the paper money S.

Figure 1:
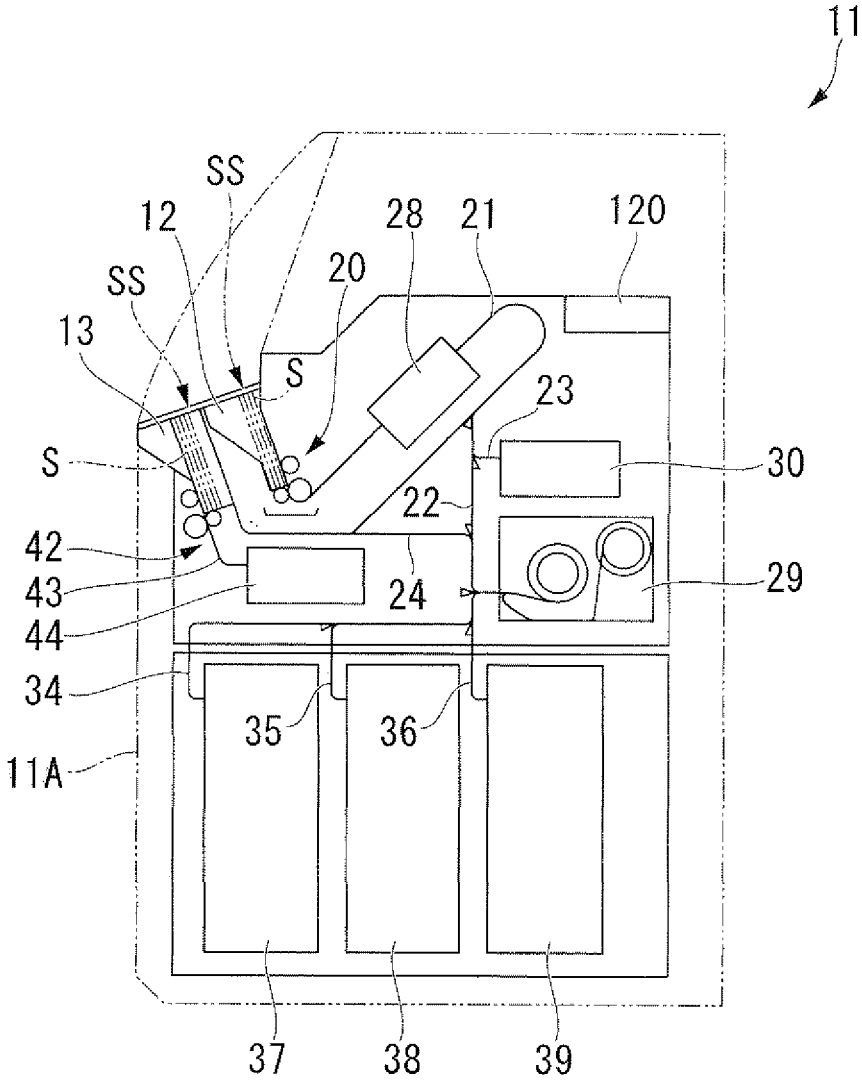
FIG. 1 is a lateral sectional view which schematically shows a paper money processor according to one embodiment of the present invention.

As shown in FIG. 1, the paper money processor 11 has an insertion slot 12 and dispensing slot 13. The insertion slot 12 is provided on the front surface 11A side of the device body, and functions as a transaction slot where the paper money S is inserted from outside the device. The dispensing slot 13 is provided further the front surface 11A side than the insertion slot 12, and functions as a transaction slot where the paper money S is dispensed from within the device.

The paper money S is inserted into the insertion slot 12 with a rearward descending orientation where one of the lengthwise ends of the paper money S is positioned on the inner side of the device body while its short side (short direction) is aligned with the horizontal direction (the lateral direction of the device body), in the state of a paper money pile SS. The paper money pile SS is a plurality of bills piled in the thickness direction of the bill. The insertion slot 12 is capable of accommodating the entirety of the bill of the paper money S which has the longest length in the lengthwise direction.

One of the lengthwise ends (the inner end, the first end) of the insertion slot 12 is positioned on the inner side of the device body, and is positioned on the underside of the device body. The other lengthwise end (the outer end, the second end) of the insertion slot 12 is positioned at the front surface side of the device body, and is positioned on the topside of the device body. That is, one of the lengthwise ends of the insertion slot 12 is positioned more to the inner side of the device body and to the underside of the device body than the other lengthwise end of the insertion slot 12. The other lengthwise end of the insertion slot 12 is positioned more to the front surface side of the device body and to the topside of the device body than the first lengthwise end of the insertion slot 12. The lengthwise direction of the insertion slot 12 aligns with the lengthwise direction of the paper money S that is inserted into the insertion slot 12. One of the lengthwise end sides of the insertion slot 12 aligns with one of the lengthwise end sides of the paper money S in the insertion slot 12. The other lengthwise end side of the insertion slot 12 aligns with the other lengthwise end side of the paper money S in the insertion slot 12. One end of the paper money S in the insertion slot 12 is positioned at one of the lengthwise end sides of the insertion slot 12. The other end of the paper money S in the insertion slot 12 is positioned at the other lengthwise end side of the insertion slot 12.

The widthwise direction of the insertion slot 12 is orthogonal to the lengthwise direction of the insertion slot 12. The widthwise direction of the insertion slot 12 runs in the lateral direction of the device body. One of the widthwise end sides (the lateral opening side) of the insertion slot 12 aligns with the right side of the device body. The other widthwise end side of the insertion slot 12 aligns with the left side of the device body. One of the widthwise ends of the insertion slot 12 is positioned on the right side of the device body. The other widthwise end of the insertion slot 12 is positioned on the left side of the device body. The widthwise direction of the insertion slot 12 runs in the widthwise direction of the paper money S in the insertion slot 12. One of the widthwise end sides of the insertion slot 12 aligns with one of the widthwise end sides of the paper money S in the insertion slot 12. The other widthwise end side of the insertion slot 12 aligns with the other widthwise end side of the paper money S in the insertion slot 12. One of the widthwise ends of the paper money S in the insertion slot 12 is positioned at one of the widthwise end sides of the insertion slot 12. The other widthwise end of the paper money S in the insertion slot 12 is positioned at the other widthwise end side of the insertion slot 12.

The height direction of the insertion slot 12 is orthogonal to the lengthwise and widthwise directions of the insertion slot 12. The height direction of the insertion slot 12 aligns with the thickness direction of the paper money S in the insertion slot 12. Consequently, in other words, the paper money S is inserted into the insertion slot 12 with a rearward descending orientation where one of the lengthwise ends of the paper money S is positioned at one of the lengthwise end sides of the insertion slot 12, and the widthwise direction of the paper money S is aligned with the widthwise direction of the insertion slot 12.

Similarly, the paper money S is dispensed into the dispensing slot 13 with a forward ascending orientation where one of the lengthwise ends of the paper money S is positioned on the inner side of the device body while its short side (widthwise direction) is aligned with the horizontal direction (the lateral direction of the device body). The dispensed bills of paper money S are piled up in the thickness direction thereof within the dispensing slot 13 to form a paper money pile SS. The dispensing slot 13 is also capable of accommodating the entirety of the bill of paper money S which has the longest length in the lengthwise direction.

On the inner side of the device body relative to the insertion slot 12 is provided a separation-and-feed unit 20 which individually separates paper money S that has been inserted into the insertion slot 12, and feeds it into the device. On the inner side of the device body relative to the separation-and-feed unit 20 is provided a conveyance path (conveyor) 21 which conveys the paper money S that is fed from the separation-and-feed unit 20. This conveyor path 21 extends upwardly toward the rear from the separation-and-feed unit 20, after which it turns back downward and extends downwardly toward the front, further extends forward in the horizontal direction, and finally extends somewhat upwardly toward the front where it connects to the dispensing slot 13.

The paper money processor 11 also has a conveyance path (conveyor) 22, a conveyance path (conveyor) 23, and a conveyance path (conveyor) 24. The conveyance path 22 branches off midway from the conveyance path 21, and extends vertically downward, after which it extends horizontally backward. The conveyance path 23 branches off from the conveyance path 22 at an intermediate position, and extends horizontally backward. The conveyance path 24 branches off from the conveyance path 22 further downstream from the branching of the conveyance path 23, and connects to the conveyor 21.

A discriminator 28 is provided on the upstream side of the conveyance path 21. The discriminator 28 discriminates and counts the paper money S that is being conveyed. Moreover, a temporary storage unit 29 is connected to the terminal position of the conveyance path 22. The temporary storage unit 29 temporarily stores the paper money S that was discriminated as normal by the discriminator 28 in mixed denominations. A collection case 30 is connected to the terminal position of the conveyance path 23. The collection case 30 stores paper money S that is discriminated as counterfeit among paper money S other than the paper money S discriminated as normal.

The paper money processor 11 also has a conveyance path (conveyor) 34, a conveyance path (conveyor) 35, and a conveyance path (conveyor) 36. The conveyance path 34 branches off from the downstream side of the conveyance path 22, and extends somewhat downward, after which it extends horizontally forward, and finally extends downward. The conveyance path 35 and conveyance path 36 branch off from intermediate positions of the conveyance path 34, and extend downward. Storage cases 37 to 39 store the paper money S that is fed from the temporary storage unit 29 by prescribed denominations. The storage cases 37 to 39 are respectively connected to the terminal positions of these conveyance paths 34 to 36.

A separation-and-feed unit 42 is provided on the inner side of the device body relative to the dispensing slot 13. The separation-and-feed unit 42 individually separates paper money S that the operator has forgotten to take after dispensation to the dispensing slot 13, and feeds it into the device. A conveyance path (conveyor) 43 is provided on the inner side of the device body relative to the separation-and-feed unit 42. A conveyance path 43 conveys the paper money S that is fed from the separation-and-feed unit 42. A forgotten money storage case 44 is provided at the terminal position of this conveyance path 43. The forgotten money storage case 44 stores the forgotten paper money S.

Figure 2:
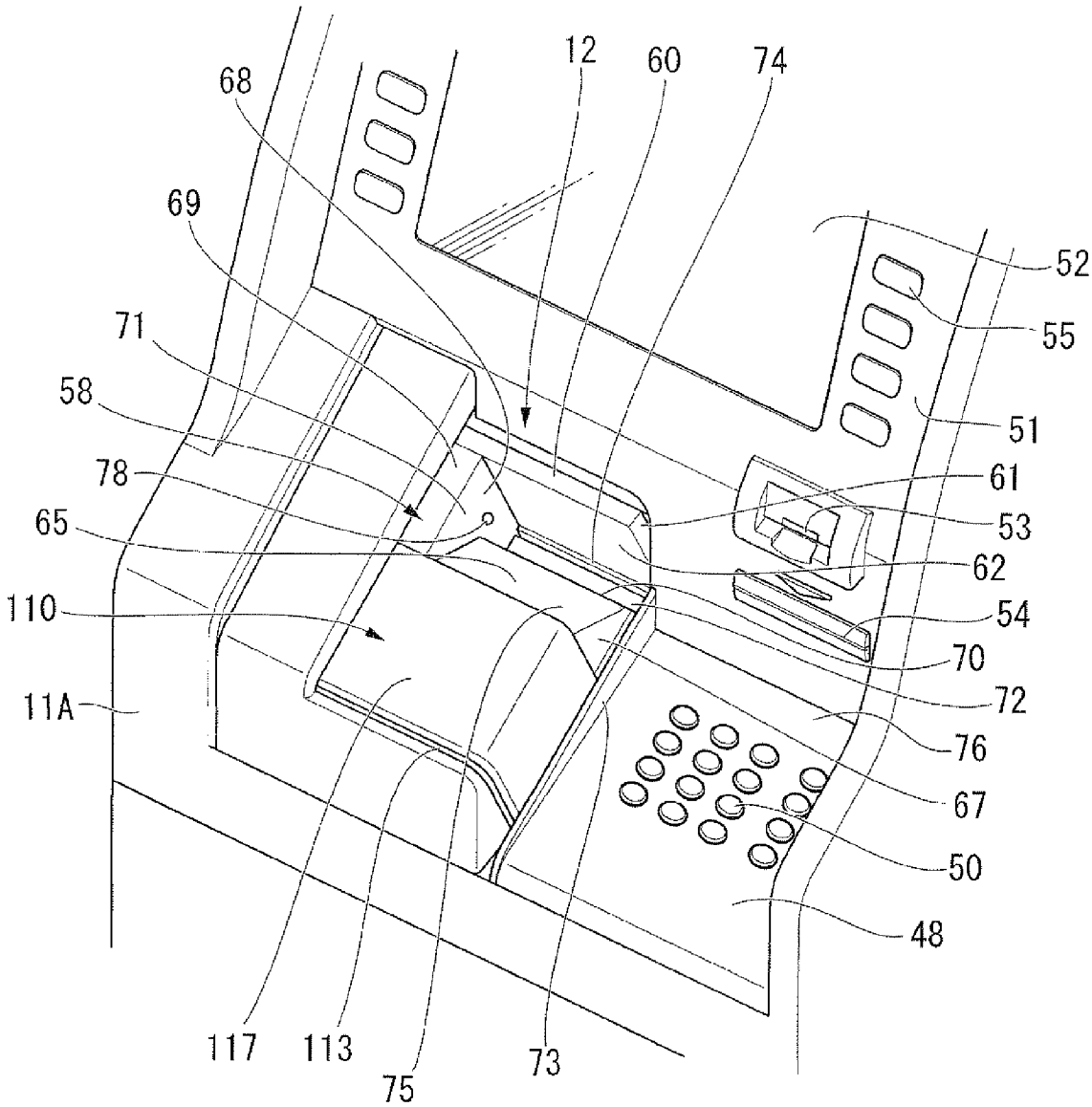
FIG. 2 is a perspective view which shows main components of the paper money processor according to the embodiment of the present invention, and shows the state where an insertion slot is open.

As shown in FIG. 2, an operating panel part 48 is provided on the right side of the front surface 11A side of the device body. The operating panel part 48 slopes somewhat downward toward the front relative to the horizontal. The operating panel part 48 is provided with a plurality of operating buttons 50 which are manipulated by an operator (a money depositing customer). A front part 51 is provided on the front surface 11A of the device body. The front part 51 rises upward from the rear edge of the operating panel part 48. The front part 51 is provided with a display screen 52 which conducts display to the operator, a card insertion slot 53, a slip issuance slot 54, and operating buttons 55 which are disposed to the right and left of the display screen 52 and which receives manipulative inputs of the operator.

Figure 3:
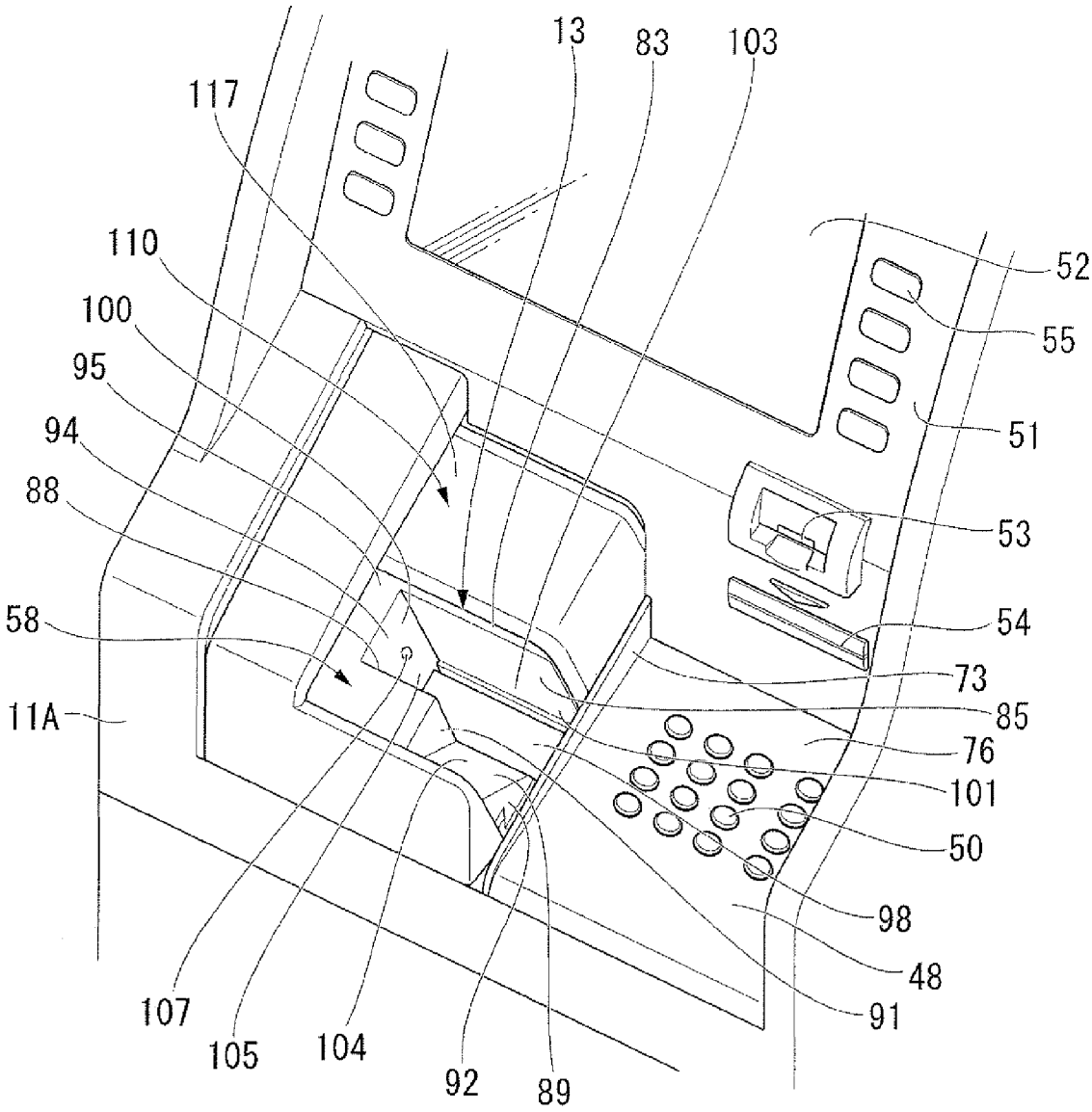
FIG. 3 is a perspective view which shows main components of the paper money processor according to the embodiment of the present invention, and shows the state where a dispensing slot is open.

The insertion slot 12 is provided on the rear side of the left side of the operating panel part 48 so as to project above the operating panel part 48. As shown in FIG. 3, the dispensing slot 13 is provided on front side of the left side of the operating panel part 48 so as to project above the operating panel part 48.

In short, a transaction slot formation member 58 which forms the insertion slot 12 and the dispensing slot 13 is provided on the left side of the operating panel part 48. As shown in FIG. 2, this transaction slot formation member 58 has a rear top face 60, a rear side face 61, and an insertion slot rear face 62. The rear top face 60 is higher than the operating panel part 48, is approximately parallel with the operating panel part 48, and has a rectangular shape that is long in the lateral direction. The rear side face 61 extends toward the interior of the device body at right angles to the rear top face 60 from the side edge of the operating panel part 48 side of the rear top face 60, and has a rectangular shape. The insertion slot rear face 62 extends toward the interior of the device body at right angles to the top rear face 60 and rear side face 61 from the front edge of the rear top face 60, and has a rectangular shape that runs in the lateral direction.

Figure 4:
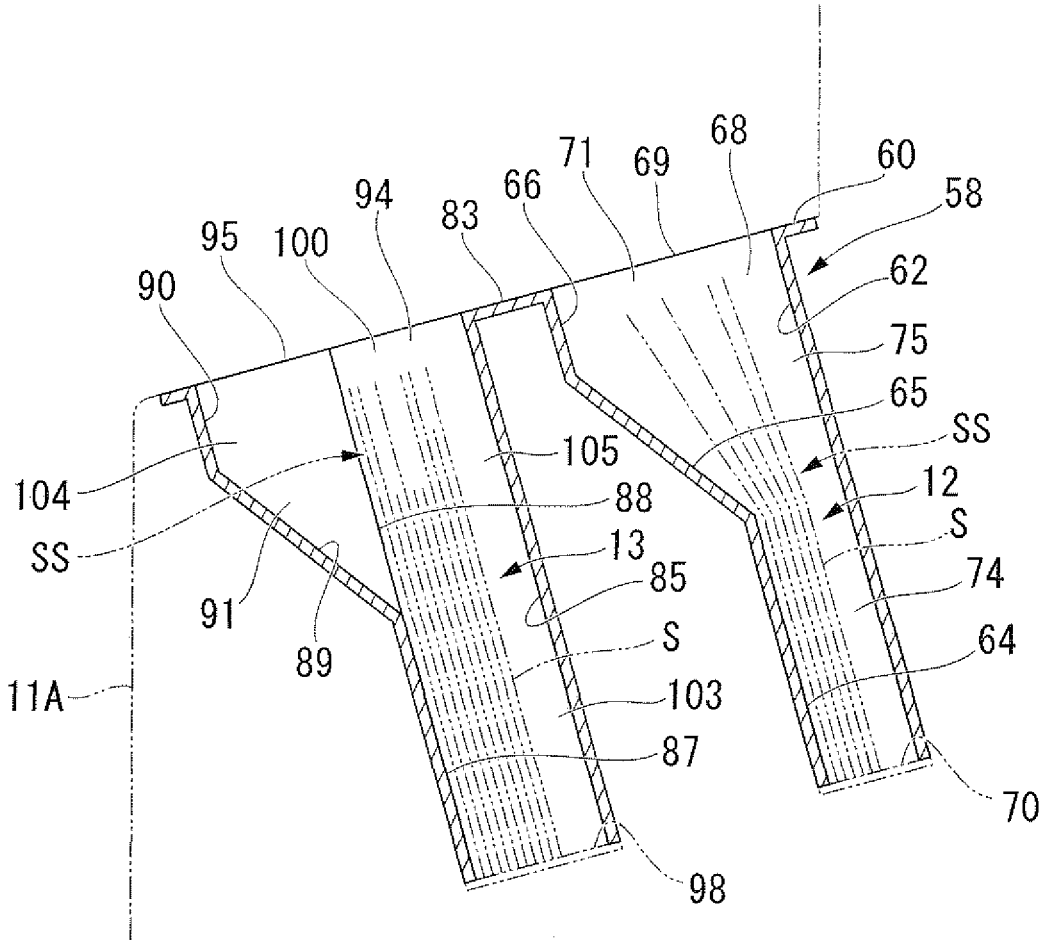
FIG. 4 is a lateral sectional view of a transaction slot formation member of the paper money processor according to the embodiment of the present invention.

As shown in FIG. 4, the transaction slot formation member 58 has an insertion slot inner front face 64, an insertion slot outer front face 65, and an insertion slot outer end front face 66, and an intermediate side face 67 which is shown in FIG. 2. The insertion slot inner front face 64 is provided on the interior side of the device body so as to oppose the insertion slot rear face 62, is parallel to the insertion slot rear face 62 and has a rectangular shape. The insertion slot outer front face 65 is provided more toward the outer side of the device body than the insertion slot inner front face 64 so as to oppose the insertion slot rear face 62 and has a rectangular shape and its distance from the insertion slot rear face 62 increases as it approaches the outer edge side. The insertion slot outer edge front face 66 extends above the upper edge of the insertion slot outer front face 65, is parallel with the insertion slot rear face 62, and has a rectangular shape. The intermediate side face 67 extends toward the interior of the device body from the side edge of the operating panel part 48 side of the insertion slot outer front face 65.

The transaction slot formation member 58 further has an insertion slot side face 68 (see, FIG. 4), and a side top face 69 (see, FIG. 2). The insertion slot side face 68 connects the respective edges of the insertion slot rear face 62, insertion slot inner front face 64, insertion slot outer front face 65, and insertion slot outer edge front face 66 which are on the side that is opposite the operating panel part 48, and is perpendicular to the lateral direction of the device body. The side top face 69 is flush with the rear top face 60, and extends from the top edge of the insertion slot side face 68 to the side that is opposite the operating panel part 48. The insertion slot outer front face 65 is positioned above the operating panel part 48.

As shown in FIG. 4, the insertion slot 12 is formed by the insertion slot rear face 62, insertion slot inner front face 64, the insertion slot outer front face 65, the insertion slot outer edge front face 66, the insertion slot side face 68, and a bottom face 70. The bottom face 70 is located at the inner side of the insertion slot rear face 62, insertion slot inner front face 64, and insertion slot side face 68, and is orthogonal to these. Into this insertion slot 12, as mentioned above, the paper money S is inserted with a rearward descending orientation such that one of its lengthwise ends is on the inner side (underside) of the device body and its short side runs in the lateral direction of the device body, in the state of a paper money pile SS with multiple bills piled in the thickness direction, and is inserted to a position where it contacts the bottom face 70. In this state, the paper money pile SS is supported principally by the insertion slot inner front face 64 and bottom face 70.

A main opening 71 is formed by the respective outer end edges of the aforementioned insertion slot rear face 62, insertion slot outer end front face 66, and insertion slot side face 68. The main opening 71 opens on the other lengthwise end side (top side) of the paper money S in the insertion slot 12. A lateral opening 72 is formed by the side edges of the insertion slot rear face 62, insertion slot outer front face 65, and insertion slot outer end front face 66 on the operating panel part 48 side as shown in FIG. 2. The lateral opening 72 opens continuously from the main opening 71 on one of the widthwise end sides (right side) of the paper money S in the insertion slot 12.

A wall plate 73 which rises upward is provided at the side edge of the operating panel part 48 on the transaction slot formation member 58 side. This wall plate 73 extends from the operating panel part 48 to the approximate height of the insertion slot outer front face 65. The lateral opening 72 is formed above this side wall 73.

As shown in FIG. 4, in the insertion slot 12, an inner narrowing portion 74 with a narrow interval (height) in the thickness direction of the paper money S is formed on the inner side of the device body by the insertion slot rear face 62 and insertion slot inner front face 64. Furthermore, in the insertion slot 12, an enlargement portion 75 is formed on the main opening 71 side by the insertion slot rear face 62 and the insertion slot outer front face 65. The enlargement portion 75 has an oblique shape so that the interval (height) thereof in the thickness direction of the paper money S widens toward the outer end. With respect to the enlargement portion 75, width in the short direction of the paper money S, that is, width in the lateral direction of the device body is approximately identical to the width of the inner narrowing portion 74.

As shown in FIG. 2, the lateral opening 72 is positioned opposite the insertion slot side face 68. The side of the lateral opening 72 that is opposite the insertion slot side face 68 (right side of the device body) is a space 76 which is above the operating panel part 48 and which is open to the outside of the device. In short, with respect to the insertion slot 12, one of the end sides of the paper money S in the short direction is open at the space 76 with interposition of the lateral opening 72, while the other end side of the paper money S in the short direction is blocked by the insertion slot side face 68.

A lamp (light unit) 78 is provided in the insertion slot side face 68 that forms the blocked side part of the insertion slot 12. The lamp 78 illuminates the interior of the insertion slot 12.

As shown in FIG. 3, the transaction slot formation member 58 has, at the front side thereof, an intermediate top face 83 and a dispensing slot rear face 85. The intermediate top face 83 is located above the operating panel part 48 and is approximately parallel to the operating panel part 48. The dispensing slot rear face 85 has a rectangular shape, extends from the front edge of the intermediate top face 83 at right angles to the intermediate top face 83 toward the interior of the device body, and runs in the lateral direction.

As shown in FIG. 4, the transaction slot formation member 58 has a dispensing slot inner front face 87, dispensing slot outer extending front face 88, dispensing slot outer inclined front face 89, dispensing slot outer end front face 90, intermediate side face 91, and a front side face 92 shown in FIG. 3. The dispensing slot inner front face 87 has a rectangular shape, is disposed on the inner side of the device body so as to oppose the dispensing slot rear face 85, and is parallel to the dispensing slot rear face 85. The dispensing slot outer extending front face 88 has a rectangular shape, is opposed to the dispensing slot rear face 85, is disposed more toward the outside of the device body than the dispensing slot inner front face 87 and on the side opposite the operating panel part 48, and is flush with the dispensing slot inner front face 87. The dispensing slot outer inclined front face 89 has a rectangular shape, is opposed to the dispensing slot rear face 85, is disposed more toward the outside of the device body than the dispensing slot inner front face 87 and on the operating panel part 48 side, and its distance from the dispensing slot rear face 85 increases toward the outer end side. The dispensing slot outer end front face 90 has a rectangular shape, extends upward from the upper edge of the dispensing slot outer inclined front face 89, and is parallel with the dispensing slot rear face 85. The intermediate side face 91 is disposed amid the dispensing slot outer extending front face 88, dispensing slot outer inclined front face 89, and dispensing slot outer end front face 90, and is perpendicular to these. The front side face 92 extends from the side edge of the dispensing slot outer inclined front face 89 on the operating panel part 48 side toward the interior of the device body.

The transaction slot formation member 58 further has a dispensing slot side face 94 (see, FIG. 4), and a side top face 95 (see, FIG. 3). The dispensing slot outer inclined front face 89 is positioned above the operating panel part 48 and wall plate 73. The dispensing slot side face 94 connects the respective side edges of the dispensing slot rear face 85, dispensing slot inner front face 87, and dispensing slot outer extending front face 88 on the opposite side from the operating panel part 48, and is perpendicular to the lateral direction of the device body. The side top face 95 is flush with the intermediate top face 83, and extends from the respective top edges of the dispensing slot side face 94, dispensing slot outer extending front face 88, and intermediate side face 91 toward the side that is opposite the operating panel part 48.

As shown in FIG. 4, the dispensing slot 13 is formed by the dispensing slot rear face 85, the dispensing slot inner front face 87, the dispensing slot outer extending front face 88, the dispensing slot outer inclined front face 89, the dispensing slot outer end front face 90, the intermediate side face 91, the dispensing slot side face 94 and a bottom face 98. The bottom face 98 is located at the inner side of the dispensing slot rear face 85, dispensing slot inner front face 87, and dispensing slot side face 94, and is orthogonal to these. Within this dispensing slot 13, as mentioned above, the paper money S is dispensed from within the device body with a forward ascending orientation such that one of its lengthwise ends is on the inner side (underside) of the device body and its short side runs in the lateral direction of the device body, in the state of a paper money pile SS with multiple bills piled in the thickness direction, and is supported principally by the dispensing slot inner front face 87, dispensing slot outer extending front face 88, and bottom face 98.

A main opening 100 is formed by the respective outer end edges of the dispensing slot rear face 85, dispensing slot outer extending front face 88, dispensing slot outer end front face 90, intermediate side face 91, and dispensing slot side face 94. The main opening 100 opens on the other lengthwise end side (top side) of the paper money S in the dispensing slot 13. As shown in FIG. 3, a lateral opening 101 is formed by the side edges of the dispensing slot rear face 85, dispensing slot outer inclined front face 89, and dispensing slot outer end front face 90 on the operating panel part 48 side. The lateral opening 101 opens continuously from the main opening 100 on one of the widthwise end sides (right side) of the paper money S in the dispensing slot 13. The wall plate 73 extends from the operating panel part 48 to the approximate height of the dispensing slot outer inclined front face 89. The lateral opening 101 is formed above this wall plate 73.

As shown in FIG. 4, in the dispensing slot 13, an inner narrowing portion 103 with a narrow interval (height) in the thickness direction of the paper money S is formed on the inner side of the device body by the dispensing slot rear face 85 and dispensing slot inner front face 87. Furthermore, in the dispensing slot 13, an enlargement portion 104 is formed on the lateral opening 101 side of the main opening 101 by the dispensing slot rear face 85 and the dispensing slot outer inclined front face 89. The enlargement portion 104 has an oblique shape so that the interval (height) in the thickness direction of the paper money S widens toward the outer end. An outer narrowing portion 105 is formed by the dispensing slot rear face 85 and the dispensing slot outer extending front face 88. The outer narrowing portion 105 is located on the side of the main opening 100 that is opposite the lateral opening 101, and has an interval (height) in the thickness direction of the paper money S identical to that of the inner narrowing portion 103 as an extension of the inner narrowing portion 103. The enlargement portion 104 and outer narrowing portion 105 respectively have a width in the short direction of the paper money S approximately half that of inner narrowing portion 103. The paper money S is supported by the dispensing slot inner front face 87 and dispensing slot outer extending front face 88 shown in FIG. 4 which form the inner narrowing portion 103 and outer narrowing portion 105, and an interstice is formed between the paper money pile SS and the dispensing slot outer inclined front face 89 that forms the enlargement portion 104.

As shown in FIG. 3, the lateral opening 101 is positioned opposite the dispensing slot side face 94. The side of the lateral opening 101 that is opposite the dispensing slot side face 94 (right side of the device body) is a space 76 which is above the operating panel part 48. In short, with respect to the dispensing slot 13, one of the end sides of the paper money S in the short direction is open at the space 76 with interposition of the lateral opening 101, while the other end side of the paper money S in the short direction is blocked by the dispensing slot side face 94.

A lamp (light unit) 107 which illuminates the interior of the dispensing slot 13 is provided in the dispensing slot side face 94 which forms the blocked side of the dispensing slot 13.

The main opening 71 of the insertion slot 12 and main opening 100 of the dispensing slot 13 are oriented (i.e., directed) in the same upward direction. Moreover, the lateral opening 72 of the insertion slot 12 and lateral opening 101 of the dispensing slot 13 are oriented (i.e., directed) in the same direction of the space 76. In this state, the insertion slot 12 and dispensing slot 13 are adjacently arranged with matching of their positions in the lateral direction and alignment forward and backward which is the thickness direction of the paper money S.

A shutter 110 has a curved shape and is capable of covering the main opening 71 and lateral opening 72 of the insertion slot 12, and the main opening 100 and lateral opening 101 of the dispensing slot 13. One shutter 110 is commonly used between the insertion slot 12 and dispensing slot 13.

Figure 5:
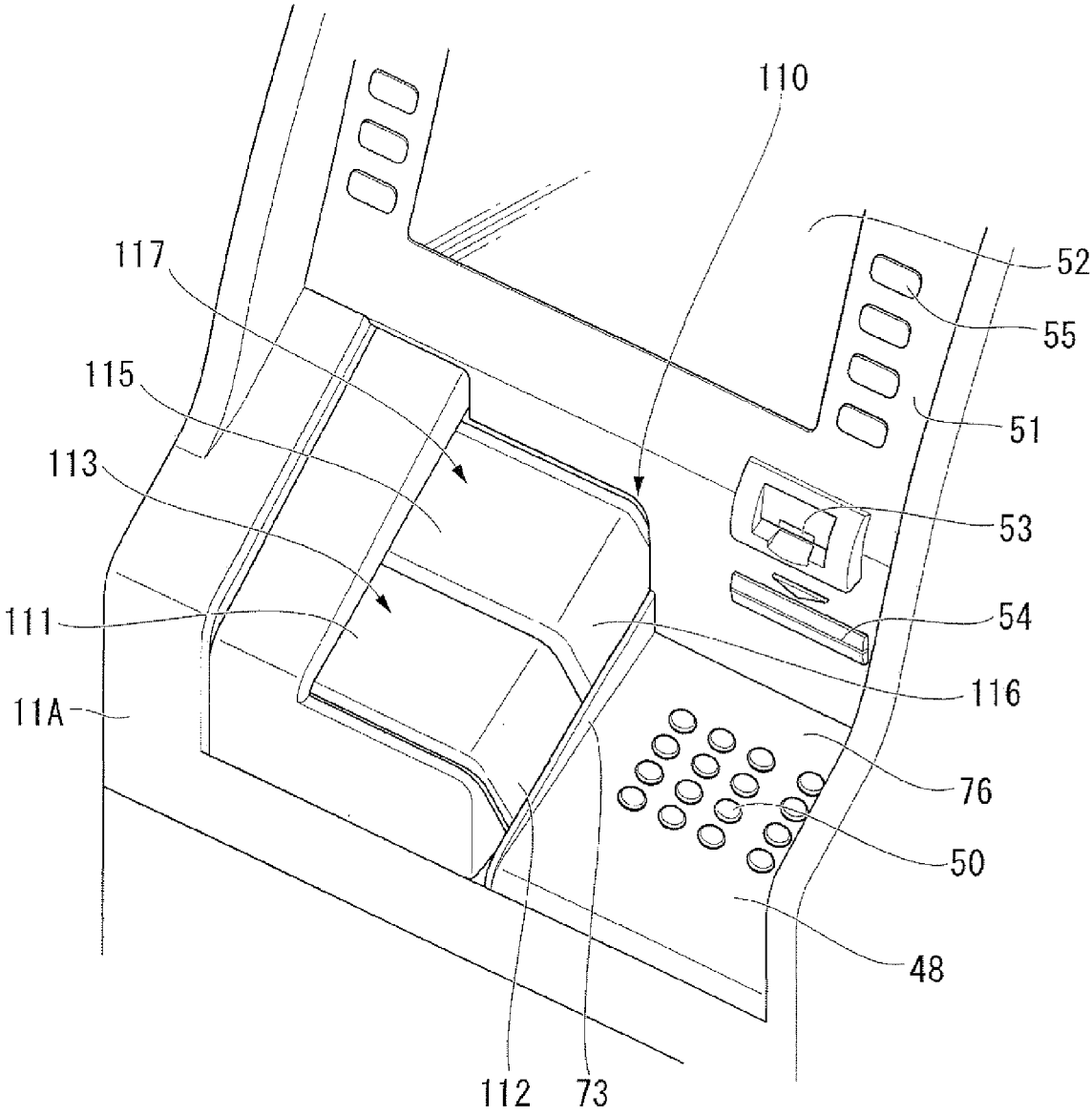
FIG. 5 is a perspective view which shows main components of the paper money processor according to the embodiment of the present invention, and shows the state where the insertion slot and the dispensing slot are covered.

As shown in FIG. 5, this shutter 110 includes an inner shutter body (shutter body) 113 and an outer shutter body (shutter body) 117. The inner shutter body 113 has a curved shape, and has a top plate 111 which is capable of opening and closing the main opening 100 side of the dispensing slot 13 shown in FIG. 3, and a side plate 112 which bends downward from the operating panel part 48 side of the top plate 111 and which is capable of opening and closing the lateral opening 101 side of the dispensing slot 13 shown in FIG. 3. The outer shutter body 117 has a curved shape, and has a top plate 115 which is capable of opening and closing the main opening 71 side of the insertion slot 12 shown in FIG. 2, and a side plate 116 which bends downward from the operating panel part 48 side of the top plate 115 and which is capable of opening and closing the lateral opening 72 side of the insertion slot 12 shown in FIG. 2. The outer shutter body 117 overlays the outside of the inner shutter body 113. That is, the shutter 110 is configured by a double overlay of the inner shutter body 113 and outer shutter body 117. The side plate 112 of the inner shutter body 113 and the side plate 116 of the outer shutter body 117 move in the interstice between the wall plate 73 and the transaction slot formation member 58.

With respect to the shutter 110, in the standby mode shown in FIG. 5, the inner shutter body 113 and outer shutter body 117 have slipped out of place (that is, they are not overlapped with each other), and the inner shutter body 113 covers the main opening 100 and lateral opening 101 of the dispensing slot 13 by the top plate 111 and side plate 112, while the outer shutter body 117 covers the main opening 71 and lateral opening 72 of the insertion slot 12 by the top plate 115 and side plate 116.

From this state, in the case where the insertion slot 12 is opened, the outer shutter body 117 is made to slide by a shutter motor which is not illustrated in the drawings while the inner shutter body 113 is in a stationary condition, and is superimposed onto the inner shutter body 113. By this means, the insertion slot 12 is opened as shown in FIG. 2. On the other hand, in the case where the dispensing slot 13 is opened, the inner shutter body 113 is made to slide by a shutter motor which is not illustrated in the drawings while the outer shutter body 117 is in a stationary condition, and is superimposed onto the outer shutter body 117. By this means, the dispensing slot 13 is opened as shown in FIG. 3.

With respect to the paper money processor 11 described above, the case will now be described where deposit and storage processing is conducted which counts the paper money S, and deposits and stores it. In this case, the operator conducts manipulative inputs aimed at initiating deposit and storage processing with the operating buttons 55 according to the guide display of the display screen 52. The shutter motor is then driven by a controller 120, thereby opening the outer shutter body 117 of the shutter 110 which is in a standby mode, and turning on the lamp 78. As a result, only the insertion slot 12 among the insertion slot 12 and dispensing slot 13 is exposed, and the interior of the insertion slot 12 is brightly illuminated.

In this state, the operator lines up the lengthwise direction and widthwise direction of the paper money S, and—in the state of a paper money pile SS piled in the thickness direction—inserts one of the lengthwise ends of the paper money S into the insertion slot 12 so as to contact the bottom face 70, whereupon the paper money pile SS is principally supported by the insertion slot inner front face 64 and bottom face 70, and all bills of the paper money S contact the bottom face 70. At this time, bills of the paper money S of short length are positioned farther in the depthwise direction than bills of the paper money S of long length. The depthwise dimensions of the insertion slot inner front face 64 are set so that even the bills of the paper money S of shortest length extend until the position of the insertion slot outer front face 65.

When the operator inputs cancellation of processing with the operating buttons 55 according to the guide display of the display screen 52, the controller 120 leaves the outer shutter body 117 of the shutter 110 in an open state. The operator removes the paper money pile SS from the insertion slot 12. In this case, the operator inserts his/her fingers into the insertion slot 12 from the enlargement portion 75 side of the lateral opening 72, grips the paper money pile SS, and withdraws it to the main opening 71 side. By this means, it is possible to satisfactorily remove bills of the paper money S of short length together with bills of the paper money S of long length. Moreover, even supposing that bills of the paper money S of short length remain in the insertion slot 12, illumination by the lamp 78 inhibits the operator from forgetting to take them, and they can be easily removed by fingers inserted from the enlargement portion 75 side of the lateral opening 72. When removal of the paper money S from the insertion slot 12 is detected by a sensor that is not illustrated in the drawings, the controller 120 drives the shutter motor to close the outer shutter body 117 and return the shutter 110 to standby mode, and extinguishes the lamp 78.

Figure 6:
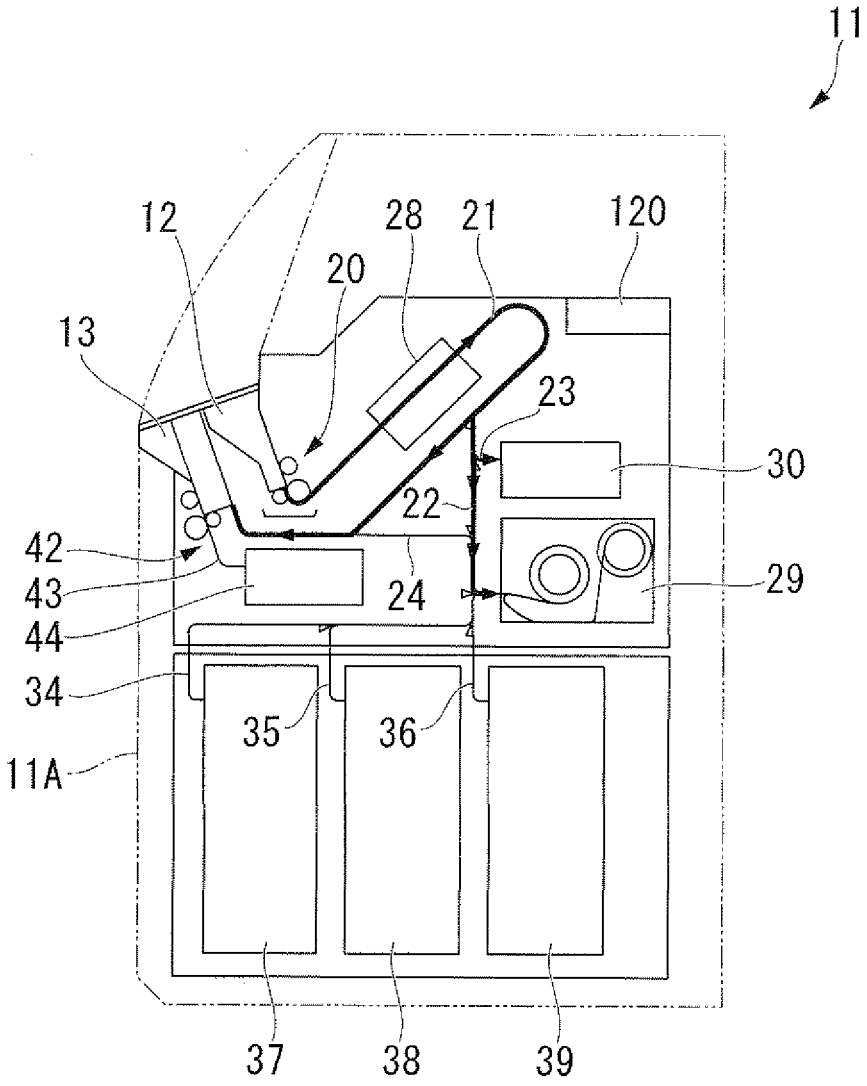
FIG. 6 is a lateral sectional view which schematically shows the paper money processor according to the embodiment of the present invention, and shows money input processing routes with bolded arrow-marked lines.

On the other hand, upon inserting the paper money pile SS into the insertion slot 12, when the operator conducts manipulative inputs aimed at executing deposit and storage processing with the operating buttons 55 according to the guide display of the display screen 52, the controller 120 drives the shutter motor to close the outer shutter body 117 of the shutter 110 which was in an open state, and extinguishes the lamp 78. Subsequently, as shown by the bolded arrow lines of FIG. 6, the controller 120 individually separates the paper money S inside the insertion slot 12 with the separation-and-feed unit 20, feeds the bills to the conveyance path 21, and discriminates them with the discriminator 28. Paper money S which is discriminated as normal by the discriminator 28 is routed to temporary storage in the temporary storage unit 29 by the conveyance paths 21 and 22. On the other hand, counterfeit bills among the paper money S that is discriminated as abnormal by the discriminator 28 are routed to the collection case 30 by the conveyance paths 21 to 23, and paper money S apart from counterfeit bills that is unrecognizable or that was sent stuck together is dispensed to the dispensing slot 13 by the conveyance path 21. The dispensed paper money S is dispensed within the dispensing slot 13 so that one of the lengthwise ends contacts the bottom face 98, and in the case of multiple bills, a paper money pile SS is constituted with sequential piling in the thickness direction.

The dispensed paper money S is principally supported by the dispensing slot inner front face 87, the dispensing slot outer extending front face 88, and the bottom face 98, and in the case of multiple bills, all bills of the paper money S basically contact the bottom face 98. The depthwise dimensions of the dispensing slot inner front face 87 are set so that even the bills of the paper money S of shortest length extend to the position of the dispensing slot outer extending front face 88 and dispensing slot outer inclined front face 89.

The controller 120 then conducts display of the discrimination results of the discriminator 28 on the display screen 52, and in the case where there is paper money S in the dispensing slot 13, drives the shutter motor to open the inner shutter body 113 of the shutter 110 which was in standby mode, and turns on the lamp 107. As a result, only the dispensing slot 13 among the insertion slot 12 and dispensing slot 13 is exposed, and the interior of the dispensing slot 13 is brightly illuminated. The operator removes the returned paper money S from the dispensing slot 13, at which time the paper money S is supported by the dispensing slot inner front face 87 and dispensing slot outer extending front face 88, resulting in formation of an interstice with the dispensing slot outer inclined front face 89. The operator inserts his/her fingers into the dispensing slot 13 from the enlargement portion 104 side of the lateral opening 101, grips the paper money S which forms an interstice with the dispensing slot outer inclined front face 89, and withdraws it from the main opening 100 side. By this means, the bills of the paper money S of shortest length can be satisfactorily removed. At this time, even supposing that bills of the paper money S of short length remain in the dispensing slot 13, illumination by the lamp 107 inhibits the operator from forgetting to take them, and they can be easily removed by fingers inserted from the enlargement portion 104 side of the lateral opening 101. When removal of the paper money S from the dispensing slot 13 is detected by a sensor that is not illustrated in the drawings, the controller 120 drives the shutter motor to close the inner shutter body 113 and return the shutter 110 to standby mode, and extinguishes the lamp 107.

Figure 7:
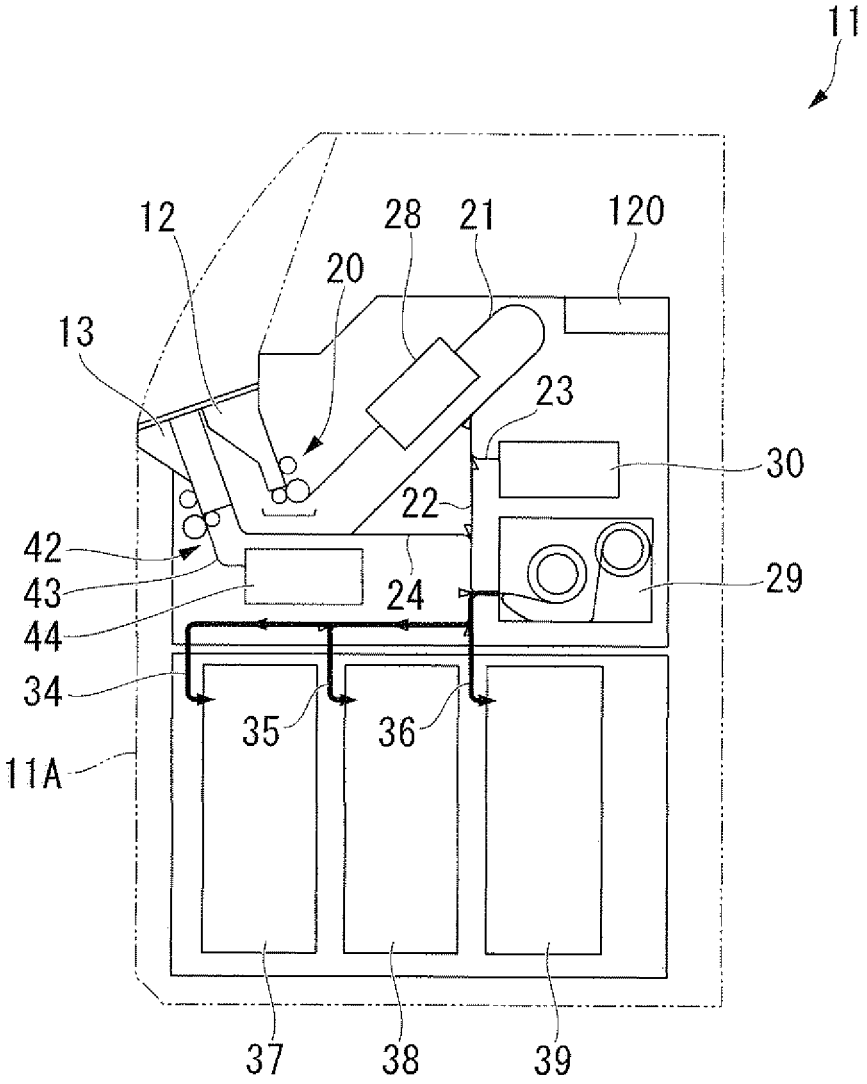
FIG. 7 is a lateral sectional view which schematically shows the paper money processor according to the embodiment of the present invention, and shows storage processing routes with bolded arrow-marked lines.
Figure 8:
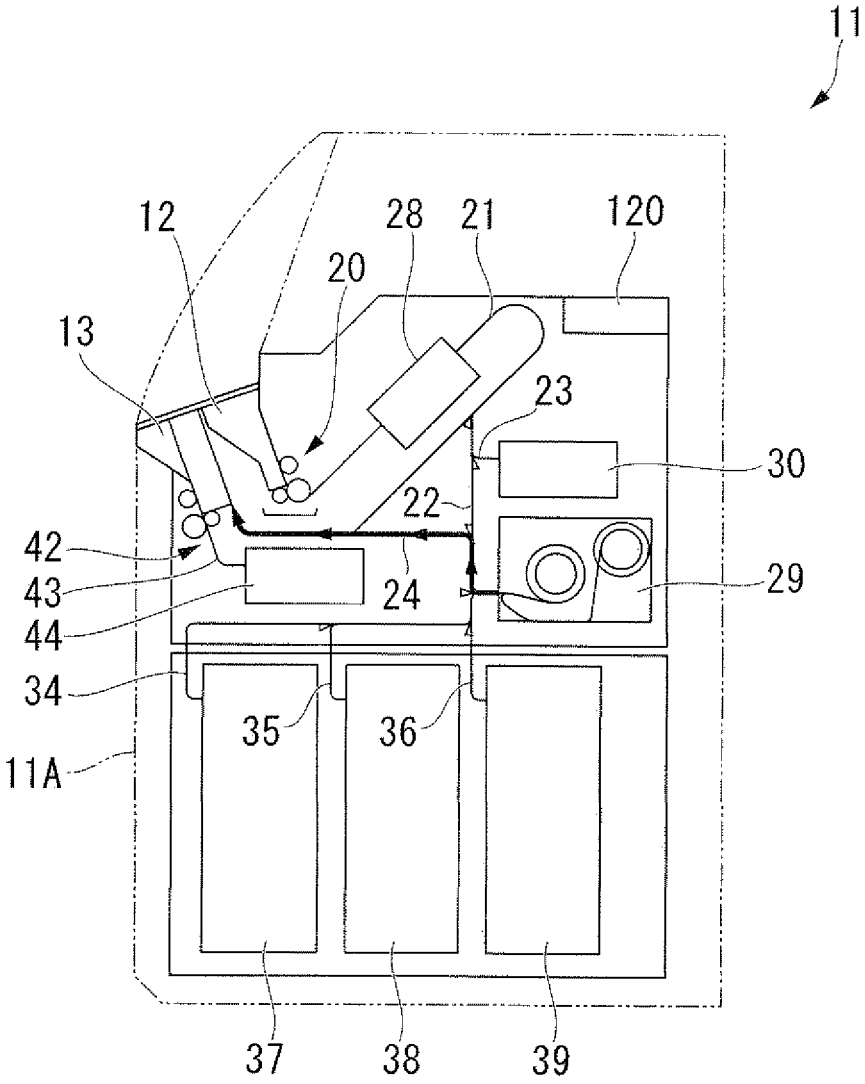
FIG. 8 is a lateral sectional view which schematically shows the paper money processor according to the embodiment of the present invention, and shows a dispensing processing route with bolded arrow-marked lines.

When the operator conducts an operational input of approval with the operating buttons 55 according to the guide display of the display screen 52, the controller 120 sorts and stores the paper money S in the temporary storage unit 29 into the storage cases 37 to 39 via the conveyance paths 22 and 34 to 36 as shown by the bolded arrow lines in FIG. 7. The paper money S is stored in the temporary storage unit 29 in the discrimination sequence of the discriminator 28, and is discharged in the reverse of the discrimination sequence. Based on this discharge sequence and the discrimination results of the discriminator 28, the paper money S is sorted to the storage cases 37 to 39.

A description will now be given of the case where counting processing is conducted to count and return the paper money S. In this case, when the operator conducts operational inputs aimed at initiating counting processing with the operating buttons 55 according to the guide display of the display screen 52, as with deposit and storage processing, the controller 120 causes the paper money S to be temporarily stored in the temporary storage unit 29. Subsequently, in contrast to deposit and storage processing, the controller 120 dispenses the paper money S of the temporary storage unit 29 to the dispensing slot 13 via the conveyance paths 21, 22, and 24, whereupon the paper money S is dispensed within the dispensing slot 13 so that one of its lengthwise ends contacts the bottom face 98, sequentially piles up in the thickness direction, and constitutes a paper money pile SS. This paper money pile SS is principally supported by the dispensing slot inner front face 87, dispensing slot outer extending front face 88, and bottom face 98, and all of the bills of the paper money S basically contact the bottom face 98. At this time, the bills of the paper money S of short length are positioned farther in the depthwise direction than the bills of the paper money S of long length. As mentioned above, the depthwise dimensions of the dispensing slot inner front face 87 are set so that even the bills of the paper money S of shortest length extend until the dispensing slot outer inclined front face 89. At this time, the paper money pile SS is supported by the dispensing slot inner front face 87 and dispensing slot outer extending front face 88, resulting in formation of an interstice between the paper money pile SS and the dispensing slot outer inclined front face 89.

When dispensing to the dispensing slot 13 of the paper money S terminates, the controller 120 drives the shutter motor to open the inner shutter body 113 of the shutter 110 which was in standby mode, and turns on the lamp 107. As a result, only the dispensing slot 13 among the insertion slot 12 and dispensing slot 13 is exposed, and the interior of the dispensing slot 13 is brightly illuminated. The operator removes the paper money pile SS from the dispensing slot 13. During this process, the operator inserts his/her fingers into the dispensing slot 13 from the enlargement portion 104 side of the lateral opening 101, grips the paper money pile SS which forms an interstice with the dispensing slot outer inclined front face 89, and withdraws it from the main opening 100 side. By this means, the bills of the paper money S of short length can be satisfactorily removed together with the bills of the paper money S of long length. Moreover, even supposing that bills of the paper money S of short length remain in the dispensing slot 13, illumination by the lamp 107 inhibits the operator from forgetting to take them, and they can be easily removed by fingers inserted from the enlargement portion 104 side of the lateral opening 101. When removal of the paper money S from the dispensing slot 13 is detected by a sensor that is not illustrated in the drawings, the controller 120 drives the shutter motor to close the inner shutter body 113 and return the shutter 110 to standby mode, and extinguishes the lamp 107.

Figure 9:
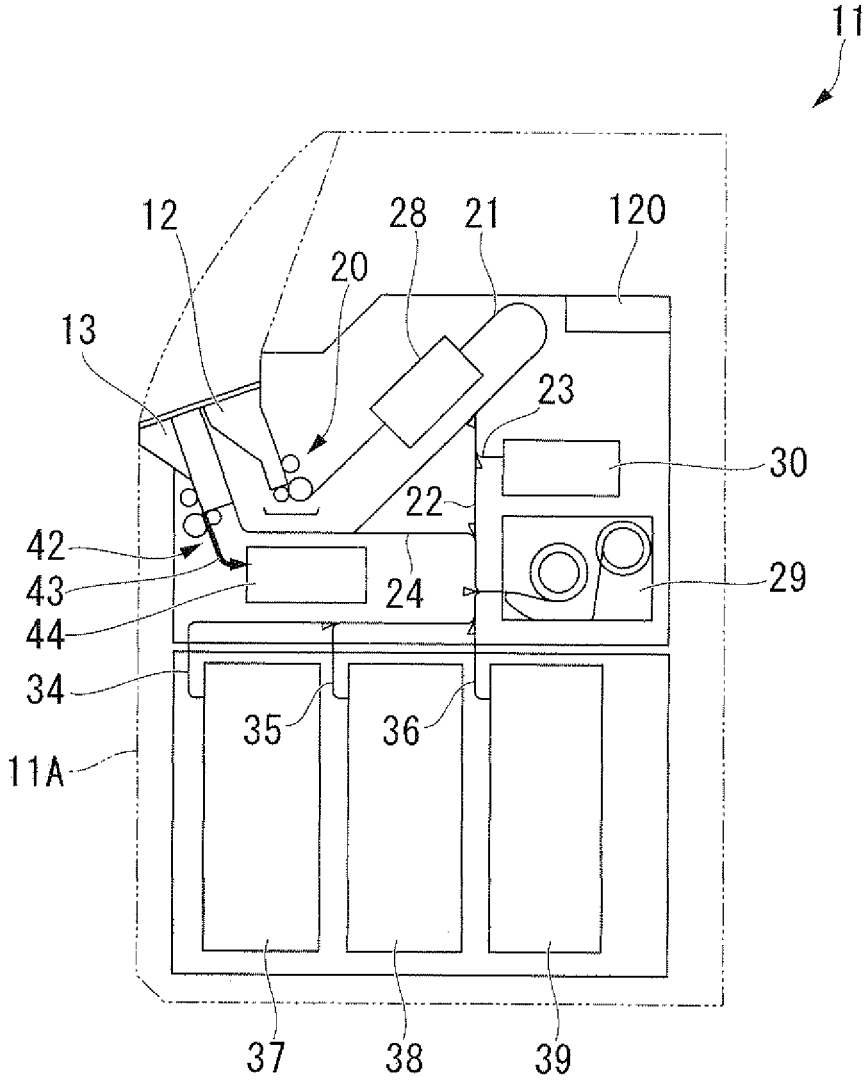
FIG. 9 is a lateral sectional view which schematically shows the paper money processor according to the embodiment of the present invention, and shows a forgotten money recovery processing route with a bolded arrow-marked line.

On the other hand, after dispensing the paper money S to the dispensing slot 13, when a sensor that is not illustrated in the drawings detects that the paper money S remains in the dispensing slot 13 after elapse of a prescribed period of time, the controller 120 drives the shutter motor to close the inner shutter body 113 and return the shutter 110 to standby mode, and extinguishes the lamp 107. Subsequently, as shown by the bolded arrow in FIG. 9, the controller 120 retrieves the bills of the paper money S in the dispensing slot 13 one by one with the separation-and-feed unit 42, and stores them in the forgotten money storage case 44 by means of the conveyance path 43.

In other words, the paper money processor 11 includes the insertion slot 12 and the dispensing slot 13. Into the insertion slot 12, paper money S is inserted with an orientation such that one of lengthwise ends of the paper money S is positioned at a side of a first lengthwise end of the insertion slot 12. The insertion slot 12 includes the main opening 71 and the lateral opening 72. The main opening 71 opens on a second lengthwise end of the insertion slot 12. The lateral opening 72 is continuous with the main opening 71, and opens on a first widthwise end of the insertion slot 12. From the dispensing slot 13, paper money S is dispensed with an orientation such that one of lengthwise ends of the paper money S is positioned at a side of a first lengthwise end of the dispensing slot 13. The dispensing slot 13 includes the main opening 100 and the lateral opening 101. The main opening 100 opens on a second lengthwise end of the dispensing slot 13. The lateral opening 101 is continuous with the main opening 100, and opens on a first widthwise end of the dispensing slot 13.

The insertion slot 12 further includes the inner narrowing portion 74 and the enlargement portion 75. The inner narrowing portion 74 positions at the first lengthwise end side of the insertion slot 12. The enlargement portion 75 positions at the second lengthwise end side of the insertion slot 12, and has an oblique shape so that a dimension in a height direction of the insertion slot 12 widens toward the second lengthwise end side of the insertion slot 12. A dimension of the inner narrowing portion 74 in the height direction of the insertion slot 12 is narrower than a dimension of at least a portion of the enlargement portion 75 in the height direction of the insertion slot 12.

The dispensing slot 13 further includes the inner narrowing portion 103, the enlargement portion 104, and the outer narrowing portion 105. The inner narrowing portion 103 positions at the first lengthwise end side of the dispensing slot 13. The enlargement portion 104 positions at the first widthwise end side of the dispensing slot 13 at the second lengthwise end side of the dispensing slot 13, and has an oblique shape so that a dimension in a height direction of the dispensing slot 13 widens toward the second lengthwise end of the dispensing slot 13. The outer narrowing portion 105 positions at a second widthwise end side of the dispensing slot 13 at the second lengthwise end side of the dispensing slot 13. A dimension of the inner narrowing portion 103 in the height direction of the dispensing slot 13 is narrower than a dimension of at least a portion of the enlargement portion 104 in the height direction of the dispensing slot 13. A dimension of the outer narrowing portion 105 in the height direction of the dispensing slot is equal to a dimension of the inner narrowing portion 103 in the height direction of the dispensing slot 13.

According to the paper money processor 11 of the present embodiment as described above, an insertion slot 12 into which paper money S is inserted from outside the device with one of its lengthwise ends on the inner side of the device body and a dispensing slot 13 from which paper money S is dispensed from inside the device with one of its lengthwise ends on the inner side of the device body respectively have a main opening 71 and 100 which opens onto the other lengthwise end side of the paper money S and a lateral opening 72 and 101 which opens continuously from the main opening 71 and 100 onto one of the widthwise end sides of the paper money S. Consequently, even in the case where a paper money pile SS with large dimensional differences is in the insertion slot 12 or dispensing slot 13, all bills of the paper money S can be simultaneously gripped from the lateral opening 72 and 100 side, withdrawn to the main opening 71 and 100 side in this state, and easily removed.

In addition, the insertion slot 12 stabilizes the orientation of the paper money pile SS with the inner narrowing portion 74 which narrows in the thickness direction of the paper money S on the inner side of the device body, and facilitates gripping of the paper money pile SS with the inclined enlargement portion 75 which widens in the thickness direction of the paper money S toward the outer end of the main opening 71 side. Accordingly, removal is further facilitated.

Moreover, the dispensing slot 13 stabilizes the orientation of the paper money pile SS with the inner narrowing portion 103 on the inner side of the device body and the outer narrowing portion 105 on the main opening 100 side which narrow by the same interval in the thickness direction of the paper money S, and facilitates gripping of the paper money pile SS at the side of the inclined enlargement portion 104 which widens in the thickness direction of the paper money S toward the outer end, more on the lateral opening 101 side than the outer narrowing portion 105 of the main opening 100. Accordingly, removal is further facilitated.

Moreover, with respect to the insertion slot 12 and dispensing slot 13 which are adjacently arranged with alignment in the thickness direction of the paper money S so that the main openings 71, 100 are respectively oriented toward the same side and the lateral openings 72, 101 are respectively oriented toward the same side, the curved shutter 110 is provided which is commonly used between the insertion slot 12 and dispensing slot 13, and is capable of covering the main openings 71, 100 and the lateral openings 72, 101. Consequently, it is possible to open and close the main openings 71, 100 and lateral openings 72, 101 of the insertion slot 12 and dispensing slot 13 with a simple structure.

In addition, the shutter 110 has an inner shutter body 113 and outer shutter body 117. Consequently, by moving the inner shutter body 113 to the outer shutter body 117 side to overlap it, the main opening 100 and lateral opening 101 of the dispensing slot 13 can be opened while the main opening 71 and lateral opening 72 of the insertion slot 12 are in a closed state, and it is also possible to move the outer shutter body 117 to the inner shutter body 113 side to overlap it, whereby the main opening 71 and lateral opening 72 of the insertion slot 12 can be opened while the main opening 100 and lateral opening 101 of the dispensing slot 13 are in a closed state. Accordingly, the insertion slot 12 and dispensing slot 13 can be selectively opened by a simple configuration.

As the insertion slot 12 and dispensing slot 13 have the lamps 78 and 107, the paper money pile SS can be reliably removed without forgetting to take bills of the paper money S of short length in particular.

The foregoing described the case of an intake-dedicated insertion slot 12 into which paper money S is inserted from outside the device and which takes the inserted paper money S into the device, and a dispensing slot 13 for combined dispensing to outside the device and intake into the device which dispenses paper money S from within the device and takes paper money S into the device. However, it is also possible to apply the aforementioned configuration of the insertion slot 12 or the configuration of the dispensing slot 13, if a transaction slot conducts either insertion from outside the device or dispensing from within the device with one of the lengthwise ends of the paper money S oriented toward the inner side of the device body, such as with a transaction slot dedicated to dispensing to outside the device which only dispenses paper money from within the device and which does not conduct intake into the device.

It is also acceptable to cover the main opening and lateral opening of a single transaction slot with a curved shutter. In this case, as well, the main opening and lateral opening of the transaction slot can be opened and closed by a simple structure.

In addition, apart from paper money deposit devices which accept deposits of paper money, the aforementioned configuration can also be applied to other paper money processors such as paper money deposit and withdrawal devices which accept deposits and allow withdrawals of paper money.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A paper money processor comprising a transaction slot where paper money is at least either inserted or dispensed with an orientation such that one of lengthwise ends of the paper money is positioned at a side of a first lengthwise end of the transaction slot, the transaction slot including:

a first side face which extends from the first lengthwise end to a second lengthwise end of the transaction slot along a lengthwise direction of the transaction slot;

a second side face which faces the first side face with a distance therebetween in a widthwise direction of the transaction slot so as to form a space for storing the paper money, the widthwise direction substantially perpendicular to the lengthwise direction, the second side face extending from the first lengthwise end to a position between the first and second lengthwise ends;

a main opening which is continuous with the space, the main opening extending from a first widthwise end of the transaction slot to a second widthwise end of the transaction slot along the widthwise direction, and the main opening opening on the second lengthwise end of the transaction slot;

a lateral opening which is continuous with the space and the main opening, the lateral opening extending from the position between the first and second lengthwise ends to the second lengthwise end along the lengthwise direction so as to substantially align with the second side face, and the lateral opening opening on the first widthwise end of the transaction slot, an inner narrowing portion which extends from the first lengthwise end toward the second lengthwise end;

an enlargement portion which is adjacent to the inner narrowing portion, the enlargement portion extending from the first widthwise end toward the second widthwise end, the enlargement portion extending from the second lengthwise end toward the first lengthwise end, and the enlargement portion having an oblique shape so that a dimension in a height direction of the transaction slot widens toward the second lengthwise end; and an outer narrowing portion which is adjacent to the inner narrowing portion and the enlargement portion, the outer narrowing portion extending from the second widthwise end toward the first widthwise end, and the outer narrowing portion extending from the second lengthwise end toward first lengthwise end, a dimension of the inner narrowing portion in the height direction of the transaction slot is narrower than a dimension of at least a portion of the enlargement portion in the height direction of the transaction slot, and a dimension of the outer narrowing portion in the height direction of the transaction slot is equal to a dimension of the inner narrowing portion in the height direction of the transaction slot, the height direction is orthogonal to the lengthwise and widthwise directions.

2. The paper money processor according to claim 1, the enlargement portion extending from the second lengthwise end toward the first lengthwise end, a dimension of the inner narrowing portion in the height direction of the transaction slot is narrower than a dimension of at least a portion of the enlargement portion in the height direction of the transaction slot.

3. The paper money processor according to claim 1, further comprising a shutter which has a curved shape, and is capable of covering the main opening and the lateral opening of the transaction slot.

4. The paper money processor according to claim 2, further comprising a shutter which has a curved shape, and is capable of covering the main opening and the lateral opening of the transaction slot.

5. The paper money processor according to claim 1, wherein the transaction slot further includes a light unit.

6. A paper money processor comprising:

an insertion slot where paper money is inserted with an orientation such that one of lengthwise ends of the paper money is positioned at a side of a first lengthwise end of the insertion slot, the insertion slot including a first side face which extends from the first lengthwise end of the insertion slot to a second lengthwise end of the insertion slot along a lengthwise direction of the insertion slot, a second side face which faces the first side face with a distance therebetween in a widthwise direction of the insertion slot so as to form a first space for storing the paper money, the widthwise direction of the insertion slot substantially perpendicular to the lengthwise direction of the insertion slot, the second side face extending from the first lengthwise end of the insertion slot to a first position between the first and second lengthwise ends of the insertion slot, a main opening which is continuous with the first space, the main opening extending from a first widthwise end of the insertion slot to a second widthwise end of the insertion slot along the widthwise direction of the insertion slot, and the main opening opening on the second lengthwise end of the insertion slot, and a lateral opening which is continuous with the first space and the main opening, the lateral opening extending from the first position between the first and second lengthwise ends to the second lengthwise end of the insertion slot along the lengthwise direction of the insertion slot so as to substantially align with the second side face, and the lateral opening opening on the first widthwise end of the insertion slot; and a dispensing slot where paper money is dispensed with an orientation such that one of lengthwise ends of the paper money is positioned at a side of a first lengthwise end of the dispensing slot, the dispensing slot including a third side face which extends from the first lengthwise end of the dispensing slot to a second lengthwise end of the dispensing slot along a lengthwise direction of the dispensing slot, a fourth side face which faces the third side face with a distance therebetween in a widthwise direction of the dispensing slot so as to form a second space for storing the paper money, the widthwise direction of the dispensing slot substantially perpendicular to the lengthwise direction of the dispensing slot, the fourth side face extending from the first lengthwise end of the dispensing slot to a second position between the first and second lengthwise ends of the dispensing slot, a main opening which is continuous with the second space, the main opening extending from a first widthwise end of the dispensing slot to a second widthwise end of the dispensing slot along the widthwise direction of the dispensing slot, and the main opening opening the second lengthwise end of the dispensing slot, a lateral opening which is continuous with the second space and the main opening, the lateral opening extending from the second position between the first and second lengthwise ends to the second lengthwise end of the dispensing slot along the lengthwise direction of the dispensing slot so as to substantially align with the third side face, and the lateral opening opening on the first widthwise end of the dispensing slot, an inner narrowing portion which extends from the first lengthwise end of the dispensing slot toward the second lengthwise end of the dispensing slot, an enlargement portion which is adjacent to the inner narrowing portion, the enlargement portion extending from the first widthwise end of the dispensing slot toward the second widthwise end of the dispensing slot, the enlargement portion extending from the second lengthwise end of the dispensing slot toward the first lengthwise end of the dispensing slot, and the enlargement portion having an oblique shape so that a dimension in a height direction of the dispensing slot widens toward the second lengthwise end of the dispensing slot; and an outer narrowing portion which is adjacent to the inner narrowing portion and the enlargement portion, the outer narrowing portion extending from the second widthwise end of the dispensing slot toward the first widthwise end of the dispensing slot, and the outer narrowing portion extending from the second lengthwise end of the dispensing slot toward the first lengthwise end of the dispensing slot, a dimension of the inner narrowing portion in the height direction of the dispensing slot is narrower than a dimension of at least a portion of the enlargement portion in the height direction of the dispensing slot, and a dimension of the outer narrowing portion in the height direction of the dispensing slot is equal to a dimension of the inner narrowing portion in the height direction of the dispensing slot, and the height direction of the dispensing slot is substantially orthogonal to the lengthwise and widthwise directions of the dispensing slot.

7. The paper money processor according to claim 6, wherein the insertion slot further includes: an inner narrowing portion which extends from the first lengthwise end of the insertion slot toward the second lengthwise end of the insertion slot; and an enlargement portion which is adjacent to the inner narrowing portion, the enlargement portion extending from the second lengthwise end of the insertion slot toward the first lengthwise end of the insertion slot, and the enlargement portion having an oblique shape so that a dimension in a height direction of the insertion slot widens toward the second lengthwise end of the insertion slot, and a dimension of the inner narrowing portion in the height direction of the insertion slot is narrower than a dimension of at least a portion of the enlargement portion in the height direction of the insertion slot, and the height direction of the insertion slot is approximately orthogonal to the lengthwise and widthwise directions of the insertion slot.

8. The paper money processor according to claim 6, further comprising a shutter which has a curved shape, is commonly used between the insertion slot and the dispensing slot, and is capable of covering the main openings and the lateral openings of the insertion slot and the dispensing slot, wherein the insertion slot and the dispensing slot are adjacently arranged with alignment in a height direction of the insertion slot so that the main openings of the insertion slot and the dispensing slot are respectively oriented to same side and the lateral openings of the insertion slot and the dispensing slot are respectively oriented to same side.

9. The paper money processor according to claim 7, further comprising a shutter which has a curved shape, is commonly used between the insertion slot and the dispensing slot, and is capable of covering the main openings and the lateral openings of the insertion slot and the dispensing slot, wherein the insertion slot and the dispensing slot are adjacently arranged with alignment in a height direction of the insertion slot so that the main openings of the insertion slot and the dispensing slot are respectively oriented to same side and the lateral openings of the insertion slot and the dispensing slot are respectively oriented to same side.

10. The paper money processor according to claim 8, wherein the shutter includes two shutter bodies which are capable of overlapping with each other.

11. The paper money processor according to claim 9, wherein the shutter includes two shutter bodies which are capable of overlapping with each other.

12. The paper money processor according to claim 6, wherein at least one of the insertion slot and the dispensing slot further includes a light unit.

13. The paper money processor according to claim 1, further comprising a space which is adjacent to the lateral opening, and is continuous with the space via the lateral opening.

14. The paper money processor according to claim 6, further comprising a space which is adjacent to the lateral openings of the insertion and dispensing slots, and is continuous both with the first space via the lateral opening of insertion slot and with the second space via the lateral opening of the dispensing slot.

* * * * *